US007721660B1

(12) United States Patent
Davis

(10) Patent No.: US 7,721,660 B1
(45) Date of Patent: May 25, 2010

(54) DEAL DRAWER

(75) Inventor: Steven R. Davis, North Lawrence, OH (US)

(73) Assignee: Diebold, Incorporated, North Canton, OH (US)

( * ) Notice: Subject to any disclaimer, the term of this patent is extended or adjusted under 35 U.S.C. 154(b) by 472 days.

(21) Appl. No.: 11/529,463

(22) Filed: Sep. 27, 2006

Related U.S. Application Data

(60) Provisional application No. 60/722,374, filed on Sep. 30, 2005.

(51) Int. Cl.
*E06B 7/32* (2006.01)

(52) U.S. Cl. ..... 109/19; 109/66; 232/43.1

(58) Field of Classification Search ..... 109/10–13, 109/17, 19, 66–68; 232/43.1, 44, 43.5, 19, 232/45, 1 E; 312/319.8, 242, 319.5; 220/476; 49/68

See application file for complete search history.

(56) References Cited

U.S. PATENT DOCUMENTS 3,145,918 A * 8/1964 Higgins et al. ..... 232/43.1
3,390,833 A * 7/1968 Harris ..... 232/43.3
5,040,652 A * 8/1991 Fish et al. ..... 70/189
5,802,991 A * 9/1998 Brown et al. ..... 109/19
5,887,916 A * 3/1999 Finkelstein et al. ..... 292/241
6,527,314 B2 * 3/2003 Brown ..... 292/336.3
6,789,860 B1 * 9/2004 DePietro et al. ..... 312/319.8
6,915,935 B2 * 7/2005 Portnoy ..... 225/38
7,182,027 B1 * 2/2007 DePietro ..... 109/19

* cited by examiner

*Primary Examiner*—Peter M Cuomo
*Assistant Examiner*—Kristina R Fulton
(74) *Attorney, Agent, or Firm*—Ralph E. Jocke; Daniel D. Wasil; Walker & Jocke

(57) ABSTRACT

A deal drawer apparatus includes a mechanism coordinating movement of the drawer between retracted and extended positions with movement of a panel that controls access to a holding area of the drawer, between open and closed positions. The mechanism includes a clutch assembly that may be disengaged to allow independent movement of either the drawer or the access panel. Subsequent movement of the drawer or the access panel may re-engage the clutch assembly. The clutch assembly includes a housing, a detent plate rotatably mounted to the housing, and a detent mechanism. When the housing and the detent plate are in an aligned position, the clutch assembly is in an engaged configuration. When the housing and the detent plate are offset from the aligned position, the clutch assembly is disengaged.

34 Claims, 8 Drawing Sheets

DEAL DRAWER

CROSS REFERENCE TO RELATED APPLICATION

This application claims benefit pursuant to 35 U.S.C. § 119(e) of provisional application Ser. No. 60/722,374 filed Sep. 30, 2005 the disclosure of which is incorporated herein by reference.

TECHNICAL FIELD

This invention relates to a deal drawer apparatus. Specifically this invention relates to a deal drawer apparatus that extends through a wall and which enables transaction related items to be transferred between a customer and a service provider.

BACKGROUND ART

Deal drawers can be used in customer service environments to carry out transactions between a transaction service provider and a customer. Deal drawers can be used in drive-through banking applications, gas station applications, payroll window applications, pharmacy applications, and other transaction environments.

Deal drawers may be used in transaction environments where it is desirable to separate the transaction service provider from the customer. The separation may be desirable for example in situations where the customer is located in an outdoor environment and the service provider is located indoors. The use of the deal drawer enables a customer and the service provider to exchange items such as cash or paperwork while maintaining the separation of the interior area where the service provider is located, and the exterior area of the customer. In other transaction environments, deal drawers may be used primarily to separate the service provider and the customer for security reasons. In some cases the customer and the service provider may view each other through a window or other opening that is configured to reduce the risk that the service provider may be threatened by a weapon. The use of the deal drawer enables the service provider and the customer to exchange items while reducing the risk that a person with access to the customer station may threaten the service provider with a weapon.

While deal drawers are useful in a variety of transaction environments, there is still room for improvement.

Thus there exists a need for a deal drawer which has one or more improved properties of operation, security, and economy.

DISCLOSURE OF INVENTION

It is an object of an exemplary embodiment to provide a deal drawer operable to extend between a wall separating a service provider side and a customer side.

It is a further object of an exemplary embodiment to provide a deal drawer with a drawer and a panel that selectively allows access to a holding area of the drawer from the service provider side. The drawer and the panel are operably connected by a mechanism operative to enable panel movement coordinated with drawer movement. The mechanism includes a clutch that enables panel movement that is not coordinated with drawer movement.

The exemplary clutch is operative to transition between an engaged configuration and a disengaged configuration. When a clutch is in an engaged configuration, movement of the drawer is coordinated with movement of the panel member. When the clutch is in a disengaged configuration, movement of the drawer is not coordinated with movement of the panel member. A force resistive to panel movement may be sufficient to disengage the clutch, whereby the drawer remains movable independently of the panel. The clutch may be returned to the engaged configuration by movement of either the drawer or the panel.

In an exemplary embodiment, the clutch includes a cylindrical housing having a first surface, a detent plate having a detent surface mounted in an independently rotational relationship adjacent the first surface, and a detent mechanism operative to selectively place the clutch assembly into an engaged configuration when the detent plate is in a predetermined rotational position relative the clutch housing.

The exemplary detent mechanism includes a plurality of spaced longitudinally extending chambers extending through openings in the first surface. A reciprocating detent member disposed in each chamber. A plurality of detent sites formed in the detent surface. When the detent plate and the clutch housing are in the aligned rotational position, each chamber is axially longitudinally aligned with a detent site and a portion of each detent member selectively extends into the respective detent site. In this configuration the clutch assembly is engaged. If the detent plate is rotationally offset from the aligned position, the detent members are disposed from the detent sites, and the clutch assembly is disengaged. In exemplary embodiments, each detent member comprises a ball member biased toward the detent surface by a spring member disposed in the chamber.

It is a further object of exemplary embodiments to provide a deal drawer having a cam member mounted in supporting connection with the drawer and movable therewith. The exemplary cam member includes a channel having an inclined portion at a first end and a straight portion at a second end. The deal drawer includes a pivot arm and a cam follower at a distal end of the pivot arm. The cam follower rides in the channel responsive to movement of the drawer member. Movement of the cam follower in the inclined portion causes pivotal movement of the pivot arm and coordinated rotation of the clutch housing.

It is a further object of exemplary embodiments to provide a pivot rod to cause movement of the panel. The pivot rod includes first and second spaced end portions disposed along a common axis and a central section that extends radially offset from the common axis. The first end of the pivot rod is operatively connected to the detent plate of the clutch. The central section of the pivot rod is engageable with the underside of the panel member. Movement of the panel into the lowered closed position is associated with rotation of the detent plate in a first angular direction. Movement of the panel into the raised position which provides access through the opening, is associated with rotation of the detent plate in an opposite angular direction. A bracket bounds a slot through which the central portion in the pivot rod extends. The pivot rod extends in the slot on the underside of the panel member and causes movement of the panel member.

It is another object of exemplary embodiments to provide a movement mechanism to selectively move the drawer between the extended and retracted positions. The movement mechanism may include a manual movement device mounted in supporting connection with the drawer. The manual movement device includes a handle and a member that extends through an elongated slot in the housing and is movable therein. In this exemplary embodiment, the drawer moves between the extended position and the retracted position responsive to force applied to the handle.

In the exemplary embodiment the force applied to the handle is transmitted to the drawer and causes movement thereof. The pivot arm rotates as the cam follower moves in the cam channel. The pivot arm transmits the force to the clutch which operatively connects the drawer and the panel for coordinated movement. The force is transmitted through the engaged clutch to move the panel in coordination with drawer movement. A resistive force on the panel above a threshold level is sufficient to disengage the clutch. With the clutch disengaged the panel and drawer move independently. The handle is operative to move the drawer, even if the clutch is disengaged. In the exemplary embodiment with the clutch disengaged, subsequent movement of the drawer or the panel is operative to re-engage the clutch.

It is a further object of exemplary embodiments to provide methods for operation and use of a deal drawer. In one exemplary mode of operation of the deal drawer, as the drawer moves between the extended position and the retracted position, the cam follower rides in the channel of the cam member. Movement of the cam follower causes coordinated rotational movement of a pivot arm operatively connected to the clutch housing. When the clutch is in the engaged configuration, movement of the clutch housing causes coordinated rotation of the detent plate member. The rotation of the detent plate rotates the pivot rod. The panel moves responsive to movement of the central section of the pivot rod.

In a second exemplary mode of operation, the panel may be prevented from coordinated movement with the drawer. Application of a resistive force above a threshold level causes the clutch to disengage, allowing independent movement of the panel and the drawer. Subsequent movement of the drawer or the panel can re-engage the clutch, and the drawer and panel will thereafter move in coordinated relation.

In another exemplary mode of operation, the panel may be moved independently of the drawer. A force applied to move the panel above a threshold level, is sufficient to cause the clutch to disengage. Subsequent movement of the panel or the drawer can re-engage the clutch for coordinated movement thereafter.

BEST MODES FOR CARRYING OUT INVENTION

Figure 1:
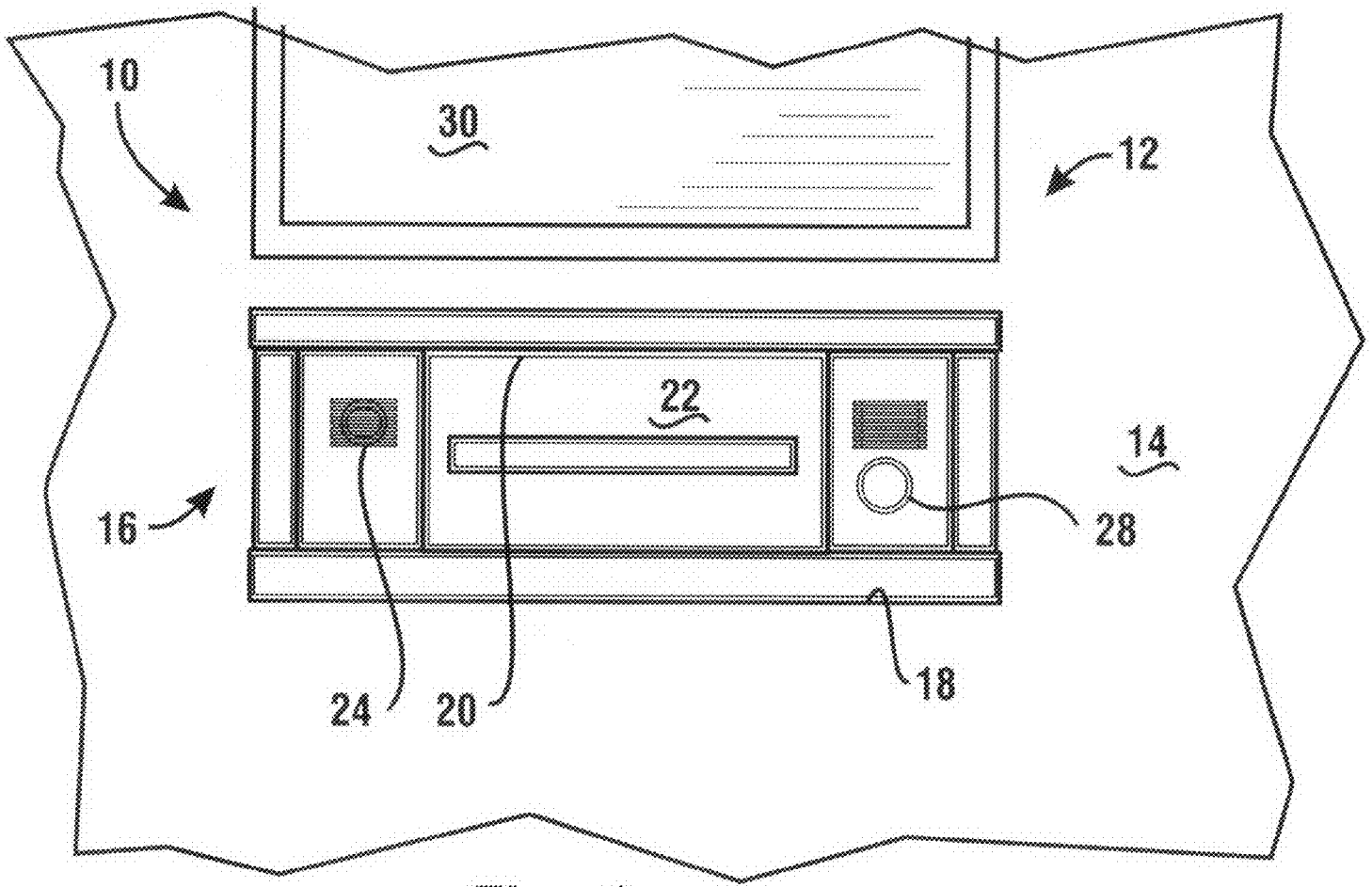
FIG. 1 is a partial front view from a customer side of a wall showing an exemplary deal drawer apparatus.

Referring now to the drawings and particularly to FIG. 1, there is shown therein a plan view of an exemplary customer service station generally indicated 10. The customer service station is shown from a customer side 12 of a wall 14. In the exemplary embodiment, wall 14 is an exterior wall of a building structure. The wall separates an area on a first side of the wall and an area on a second side of the wall. Of course in other embodiments other kinds of walls or dividing structures may be used.

Service station 10 further includes a deal drawer 16 of an exemplary embodiment. Deal drawer 16 includes fascia 18. Fascia 18 includes an opening 20 therethrough. A door 22 which is shown in the closed position, is movable to open and close the fascia opening 20 in a manner that is later discussed.

The exemplary embodiment of the fascia 18 includes input and output devices. The exemplary output devices in the embodiment shown include a speaker/microphone combination 24 which includes a speaker for providing audio outputs. Speaker/microphone combination 24 also includes a microphone which enables the customer to provide audible inputs. A further exemplary input device shown in this embodiment is a call button 28. Call button 28 is the exemplary embodiment may be used by a customer to provide a signal to a service provider located on the service provider side of wall 14 to indicate that the customer is at the service station and/or requires attention.

The exemplary form of service station 10 further includes a viewing apparatus 30. In the exemplary embodiment, the viewing apparatus 30 comprises a window through which a service provider may view a customer. In alternative embodiments the viewing apparatus may include a camera, periscope or other device through which the service provider can view the customer. In the exemplary embodiment the viewing apparatus 30 also enables the customer to view the service provider. In some other embodiments, the viewing apparatus may include a display, projection device, or other apparatus which presents an image of a service provider to a customer.

Figure 2:
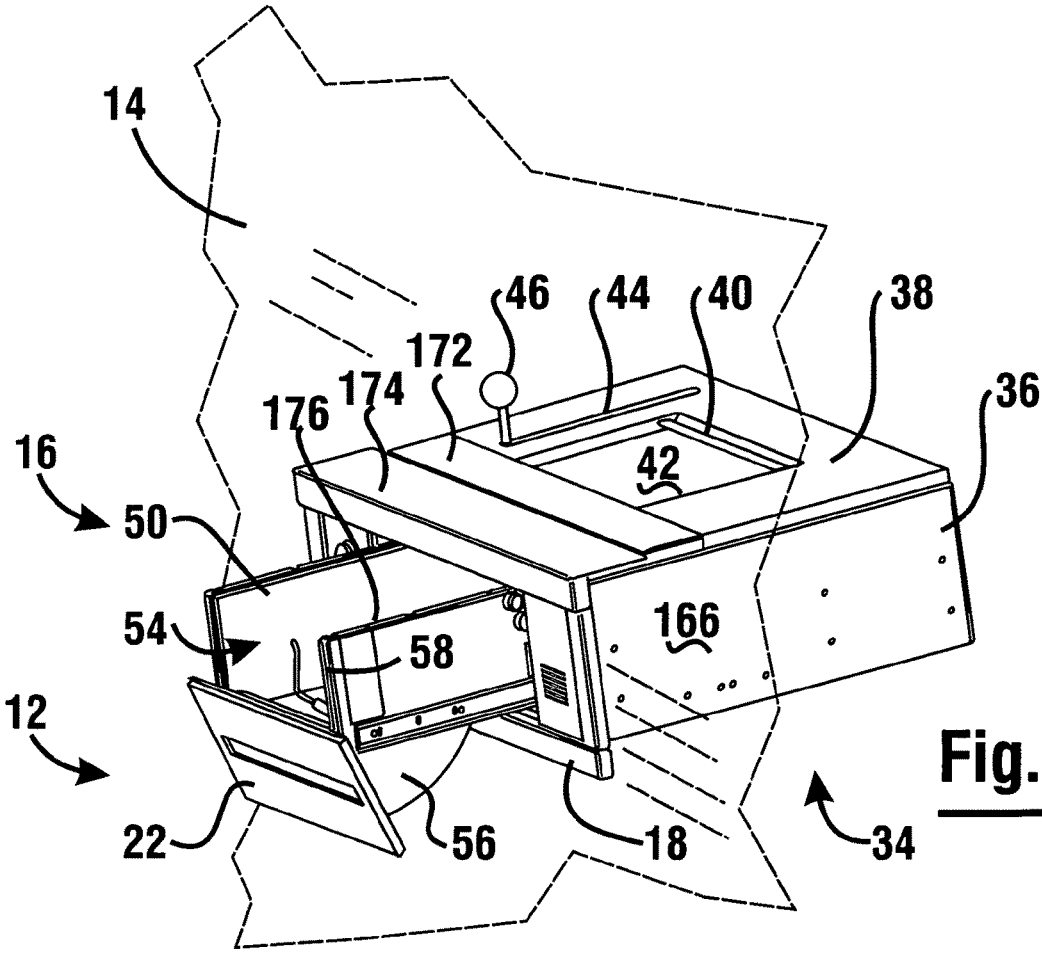
FIG. 2 is an isometric view of an exemplary deal drawer apparatus showing a drawer in an extended position and a panel in a lowered position.
Figure 3:
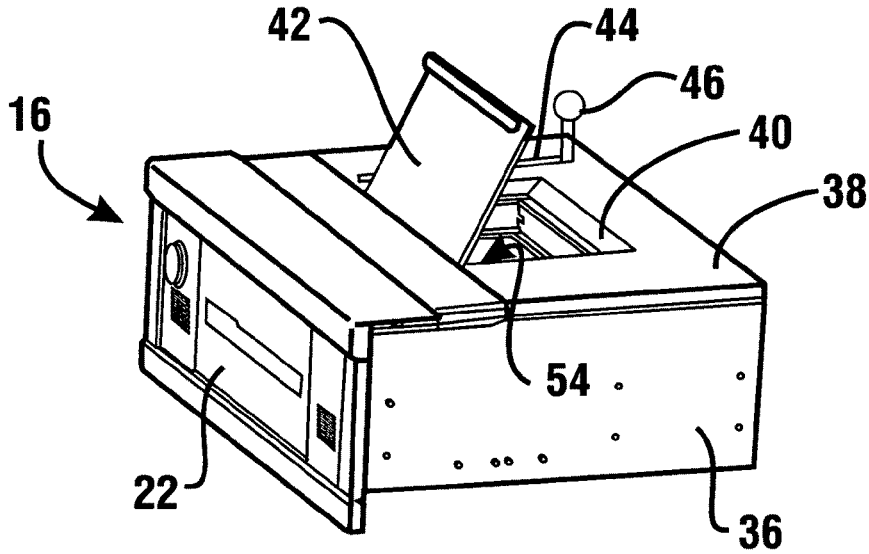
FIG. 3 is an isometric view of the exemplary deal drawer apparatus of FIG. 2 showing the drawer in a retracted position and the panel in a raised position.

FIGS. 2 and 3 illustrate an exemplary deal drawer 16 with wall 14 shown in phantom in FIG. 2. The exemplary deal drawer allows transactions to be conducted between a customer on the customer side 12, and a service provider on the service provider side 34 of wall 14. As shown in the FIGS. 2-3, the exemplary deal drawer includes a housing 36 that extends into the service provider area from the wall 14. The housing includes an upper wall component 38. Upper wall component 38 has an upper opening, or access opening, 40 therethrough. A panel 42 is movably mounted in operatively supported connection with the housing. The panel is movable to control access through the access opening 40. Upper wall 38 includes a further opening comprising an elongated slot 44. The exemplary embodiment includes a manual movement device, such as a handle with a knob member 46, which is movable within the slot 44 as will be discussed in further detail below.

As illustrated, an exemplary drawer 50 is selectively movable between an extended position (FIG. 2) and a retracted position (FIG. 3). In the extended position, an inner compartment 54 of the drawer 50, is accessible from the customer side 12. In the retracted position, the inner compartment 54 is accessible from the service provider side 34 through access opening 40 when panel 42 is in a raised position, as shown in FIG. 3. In the exemplary embodiment, door 22 moves downward from a covering position in front of an opening to the inner compartment 54 as the drawer 50 extends outward, to provide easy access to the inner compartment. In the exemplary embodiment, the drawer 50 has an open top side. With reference to FIG. 2, in the exemplary embodiment, door 22 is supported by a pair of disposed members referred to as drop flanges 56. Drop flanges 56 are movable in gaps 58 as will be explained in greater detail below.

Figure 4:
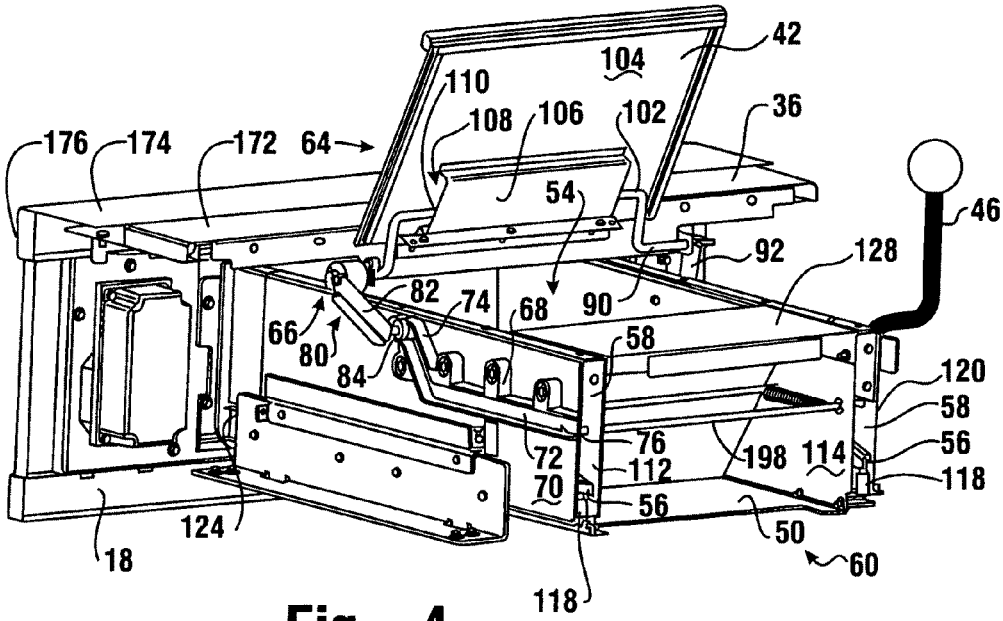
FIG. 4 is a right side isometric view of the exemplary deal drawer apparatus of FIG. 3, the view not showing some housing elements.
Figure 5:
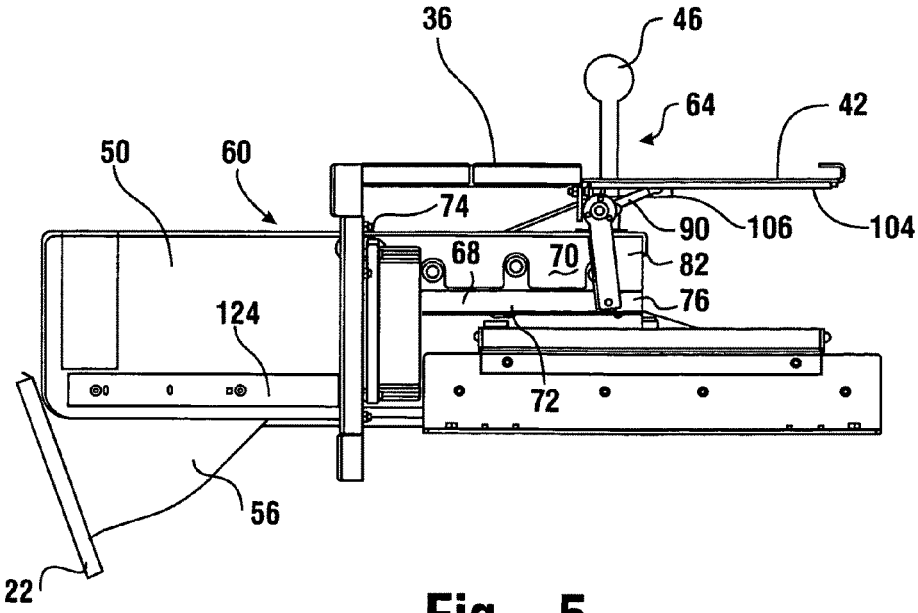
FIG. 5 is a right side view of the exemplary deal drawer apparatus of FIG. 2, the view not showing some housing elements.
Figure 6:
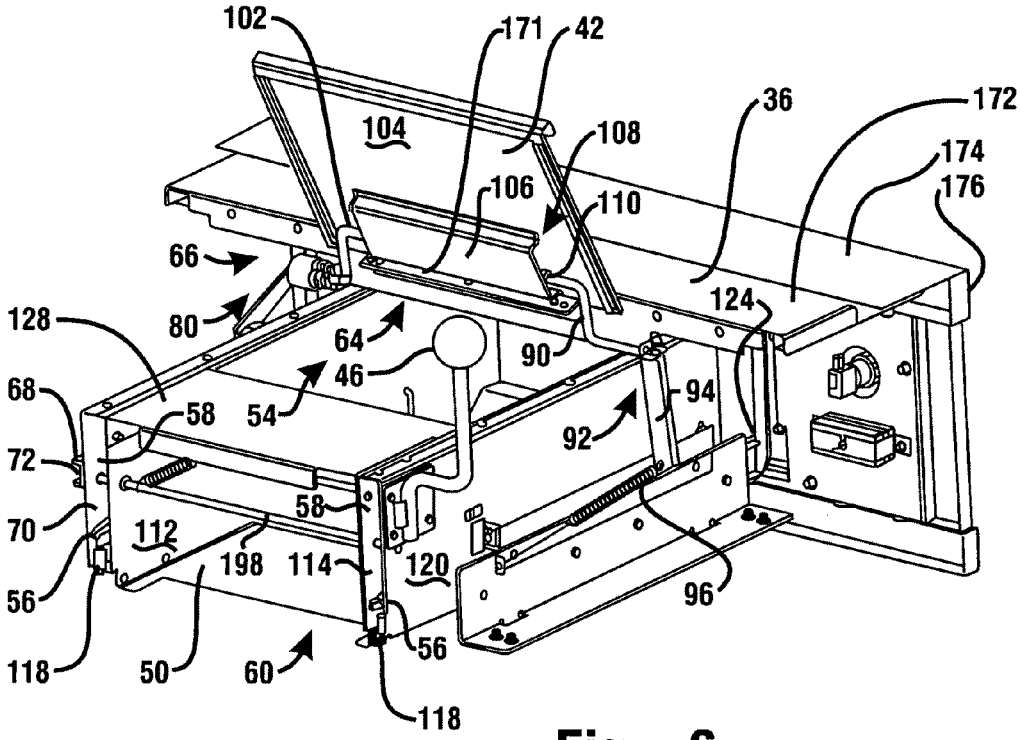
FIG. 6 is a left side isometric view of the exemplary deal drawer apparatus of FIG. 3, the view not showing some housing elements.
Figure 7:
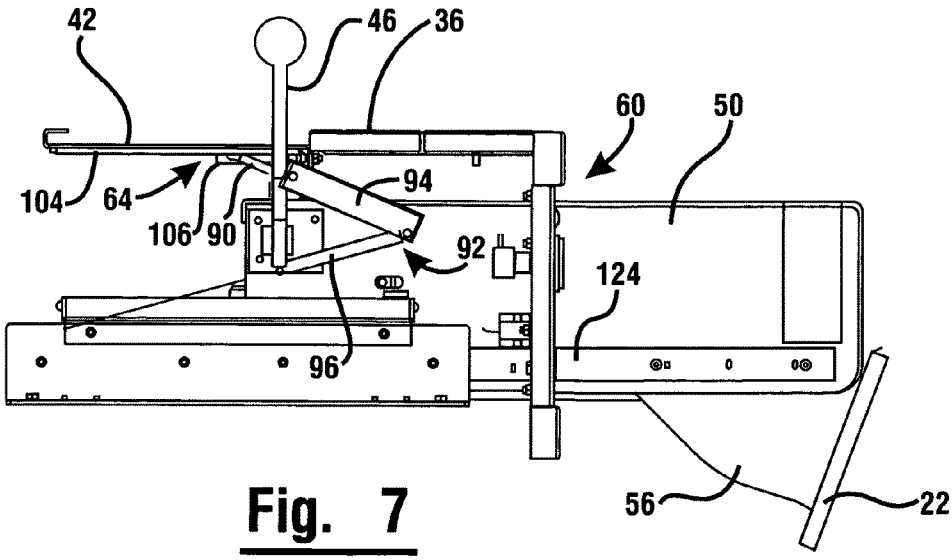
FIG. 7 is a left side view of the exemplary deal drawer apparatus of FIG. 2, the view not showing some housing elements.

FIGS. 4-7 and 15 show greater detail of the deal drawer with certain elements of the housing not shown. The exemplary embodiment includes a drawer assembly generally denoted 60 comprising movable drawer 50. The drawer is selectively movable between a retracted position (FIGS. 4 and 6) and an extended position (FIGS. 5 and 7). A panel 42 is movable between an open position (FIGS. 4 and 6) and a closed position (FIGS. 5 and 7). Movement of the panel 42 in the exemplary embodiment, may be coordinated with movement of the drawer 50 through a mechanism, generally denoted 64 enabling such coordinated movement. The mechanism includes a clutch 66. The exemplary clutch includes a detent mechanism as later explained.

In an exemplary embodiment, a cam member 68 is carried on a first side component 70 of the drawer assembly 60. Cam member 68 comprises a channel 72 having an inclined portion 74 disposed toward the front of the drawer 50 and a straight portion 76 disposed toward the rear of the drawer 50.

The exemplary clutch 66 is operatively connected to a pivot arm assembly generally denoted 80, best seen in FIG. 4. The pivot arm assembly 80 includes a pivot arm 82 and a cam follower 84 mounted at a distal end of the pivot arm 82. The cam follower extends in the channel 72. In the exemplary embodiment, the pivot arm 82 is mounted for rotational movement relating to the housing. The arm moves rotationally responsive to movement of the cam follower 84. The illustrated pivot arm assembly is of an exemplary construction whereby force applied to move the drawer is transmitted to the panel through the clutch 66. Other constructions may be used in other embodiments and may operate to transmit an applied force. For example, in other embodiments other forms of arms, shafts, and cams may be employed.

The exemplary mechanism 64 also includes a pivot rod 90 in operative connection at a first end portion with clutch 66. The pivot rod is in operative connection with a counterweight mechanism 92 at a second end portion. The counterweight mechanism 92 includes a counterweight 94 and a biasing member or spring 96. (FIGS. 6 and 7).

In the exemplary embodiment, the first and second end portions of pivot rod 90 extend along a common axis, while a central portion 102 is offset in a radial direction from the common axis. The central portion 102 extends in a slot region at the underside 104 of the panel 42. The slot region is bounded by bracket 106. The central portion of the pivot rod mounts within the slot region 108 defined by a spaced portion of bracket 106. The central portion 102 may include rolling spacers 110 or other devices to facilitate movement of the central portion 102 in the slot region. (FIGS. 4 and 6). Of course in other embodiments other approaches may be used.

With continued reference to FIGS. 4 and 6, exemplary drawer assembly 60 includes a first side wall 112 and a second side wall 114. First and second side walls 112, 114, respectively, are each separated from first and second side components 70, 120, respectively, by a gap 58. Drop flanges 56 are movable within gaps 58 and are engaged at the rear of the drawer assembly 60 with spring members 118.

As shown in FIGS. 4-7 and 15, various slide assemblies 124 direct the movement of drawer 50 between the extended and retracted positions.

In the exemplary embodiment, the drawer assembly 60 includes a drawer liner element 128 which cooperates with first and second side walls 112, 114, respectively, to define the holding area 54.

Figure 8:
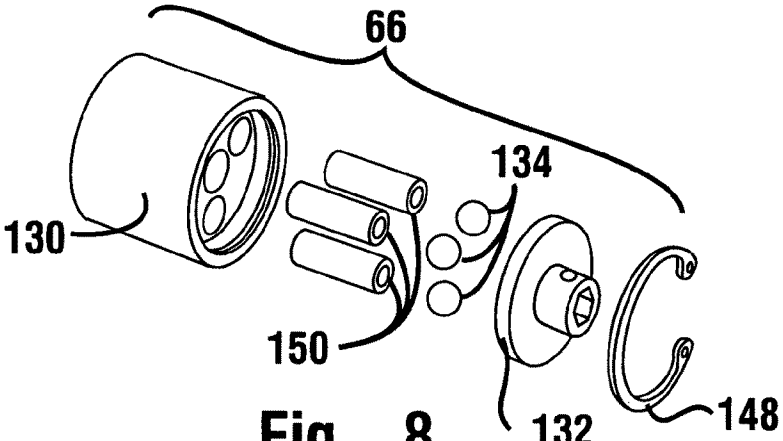
FIG. 8 is an exploded view of an exemplary clutch assembly.
Figure 9:
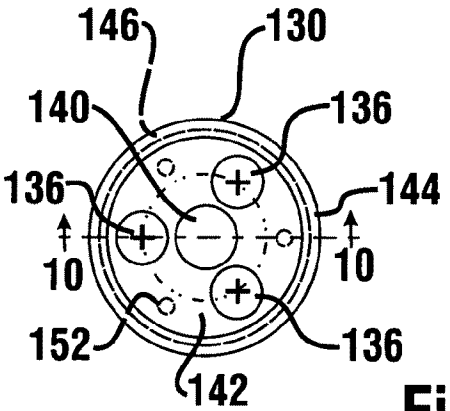
FIG. 9 is a top view of a clutch housing.
Figure 10:
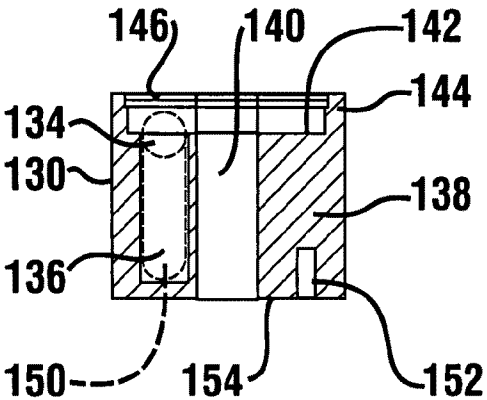
FIG. 10 is a cross sectional view of the clutch housing taken along line 10-10 of FIG. 9.

The construction of the exemplary clutch 66 is described with particular reference to FIGS. 8-11. Clutch 66 includes a clutch housing 130, a detent plate 132, and a plurality of detent members 134. With particular reference to FIGS. 9 and 10, the clutch housing 130 includes a plurality of longitudinal chambers 136 formed in the body 138 of housing 130. In the exemplary embodiment, the clutch housing 130 includes three such chambers 136 equally angularly disposed about a central opening 140 so that the centerline of each chamber is angularly disposed 120° from the centerline of an adjacent chamber. A first recessed surface 142 is disposed at a first end of the housing 130 for reception of the detent plate 132 and surrounded by a raised flange 144. In the exemplary embodiment, flange 144 includes an internal groove 146 therein for reception of a retaining member or ring 148 (FIG. 8). With reference to FIGS. 8 and 10, each longitudinal chamber 136 is adapted for receiving a detent member, which in the exemplary embodiment comprises a ball member 134. The ball member 134 is operatively engaged with a compression spring member 150, whereby ball member 134 is adapted for reciprocal longitudinal movement within the chamber 136. As shown in FIGS. 9 and 10, the housing 130 also includes a plurality of mounting bores 152 through a second surface 154 for securing the clutch housing 130 to the pivot arm assembly 80.

Figure 11:
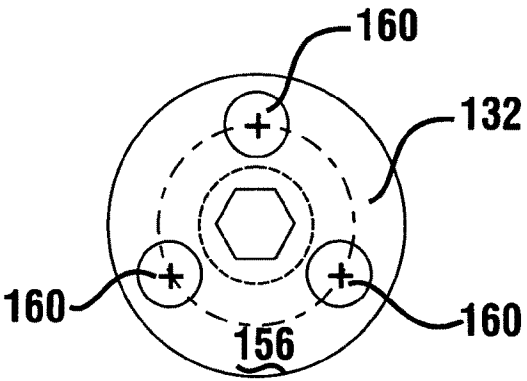
FIG. 11 is a bottom view of a detent plate showing an exemplary detent surface.

With reference to FIG. 11, exemplary detent plate 132 includes a detent surface 156 adapted for mounting in rotational relationship with the first surface 142 of clutch housing 130. The detent surface 156 includes a plurality of detent sites 160 dimensioned to receive a portion of the detent member therein, when the detent plate and the clutch housing are in a predetermined "aligned rotational position." By "aligned rotational position" it is meant that each of the longitudinal chambers is axially aligned with a respective detent site so that a portion of each detent member extends into a respective detent site. If the detent plate and the clutch housing are "offset" from the aligned position, the detent members are disposed from the detent sites, and the detent sites are not axially aligned with the longitudinal chambers.

In the exemplary embodiment when the clutch housing 130 and the detent plate 132 are in the aligned rotational position, the clutch assembly is said to be in an "engaged configuration." When the clutch housing 130 and the detent plate 132 are offset from the aligned position, the clutch assembly is said to be in a "disengaged configuration." In the exemplary embodiment, the spring members 150, ball members 134, longitudinal chambers 136, and detent sites 160 cooperate to provide an exemplary form of detent mechanism to selectively place the clutch assembly into an engaged configuration. Of course, the illustrated construction of clutch 66 is exemplary, and in other embodiments other constructions may be used.

For example, other constructions allowing for a clutch or other device to transition between an engaged configuration and a disengaged configuration may be used. Additionally, in some embodiments more or fewer detent members may be utilized. Further, the clutch or other device may comprise a shape other than the cylindrical one shown. For example, in some embodiments other types of mechanisms that operate to transmit force between two members may be provided. Such devices or materials may provide for transmission of force up to a certain level. However, upon exceeding a force level relative movement is permitted. In still other embodiments devices may be provided that operatively engage two members then release the members in response to a force and then later can be again engaged. Such devices may include mechanical devices as well as devices that operate using electrical, magnetic or other principles. Numerous different types of engaging devices may be used in connection with different embodiments.

The exemplary clutch operates to receive a transmitted force applied thereto due to movement of the drawer and causes coordinated movement between the drawer and the panel. Additionally, the clutch may be disengaged upon application of force resistive to panel movement. When the clutch is disengaged, the drawer remains movable between the extended position and the retracted position, and the panel remains generally freely movable until the clutch is re-engaged.

Figure 12:
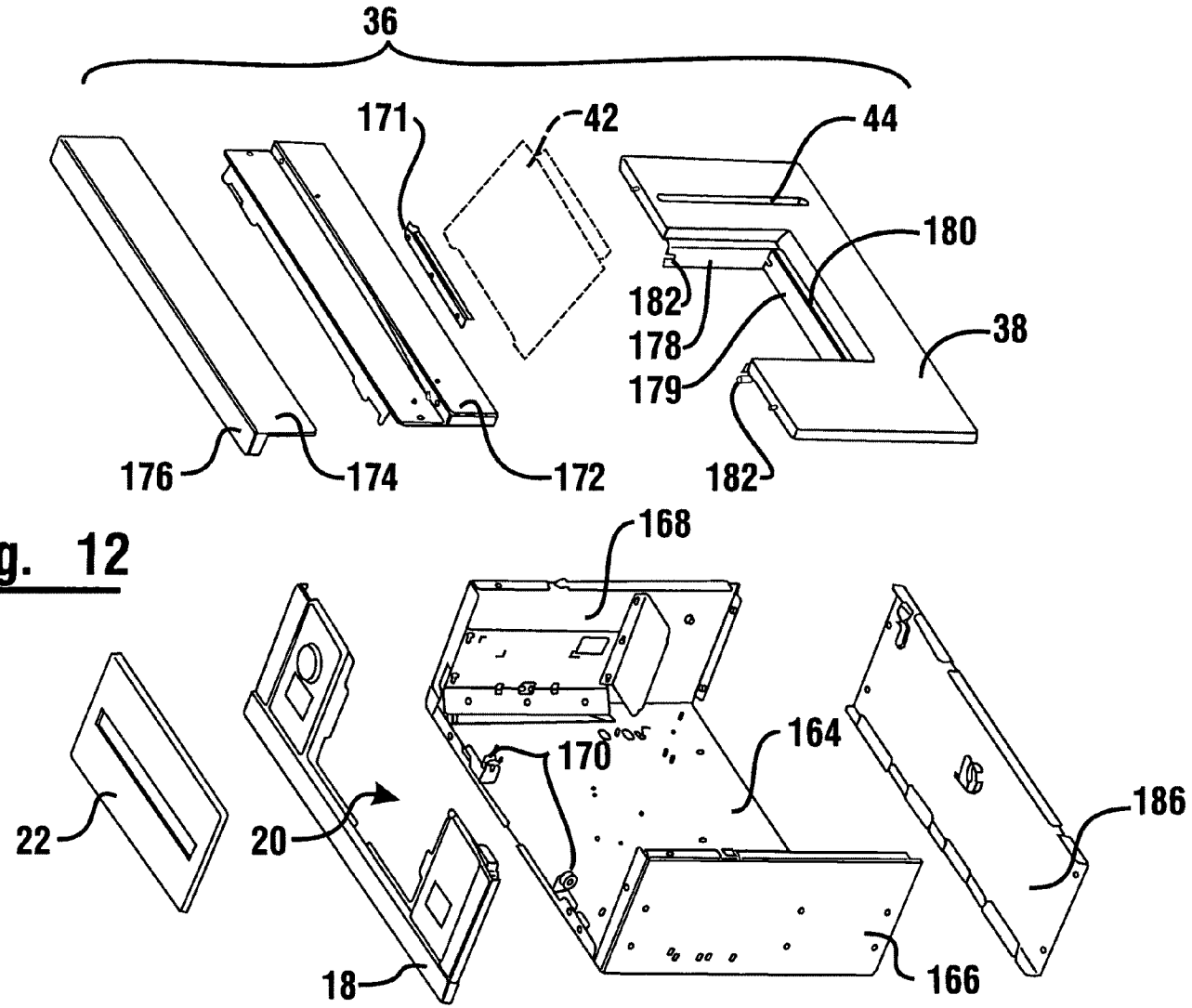
FIG. 12 is an exploded view of the housing of an exemplary deal drawer apparatus.

FIG. 12 illustrates exemplary components of housing 36. The exemplary housing includes a base 164 having first and second upwardly extending wall members 166, 168, respectively. Supported on base 164 are a pair of drop flange rollers 170 for supporting cam surfaces at the bottom of the drop flanges 56 as the drawer 50 extends and retracts.

Exemplary panel 42 (shown in phantom) is hingedly connected (via hinge component 171) to main hinge 172 to allow selective covering and uncovering of access opening 40 in the upper wall component 38. The hinge component 171 is also shown in FIG. 6. Trim member 174 is adapted to extend through wall 14 so that a front surface 176 is operably associated with fascia 18. Door 22 is operative to selectively open and close opening 20.

The exemplary access opening 40 is partially bounded by first and second side trim brackets 178 and a rear trim bracket 179 which cooperate to form a ledge 180 engaged by panel 42 in the lowered position. First and second side trim brackets 178 include cutouts 182 on their forward ends which support the first and second ends of pivot rod 90 (not shown). Alternate embodiments of rear panel assembly 186, 186' are described in greater detail with reference to FIGS. 13 and 14.

Figure 13:
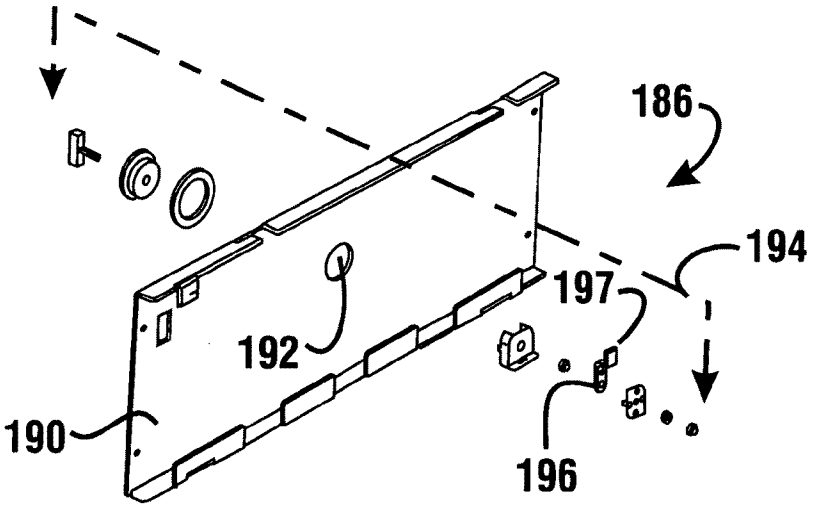
FIG. 13 is an exploded view of a rear panel assembly.

With particular reference to FIG. 13, exemplary rear panel assembly 186 includes a rear panel 190 adapted to be supported on base 164. Rear panel 190 includes an opening 192 through which latch assembly 194 extends. Latch assembly 194 includes a movable latch member 196 having an arm 197 to selectively engage or disengage a flange rod 198 disposed at the rear of the drawer 50 (See FIGS. 4 and 6) to selectively prevent or allow movement of drawer 50 relative to housing 36. In the exemplary embodiment, latch assembly 194 is disposed so that the flange rod 198 may be engaged from below when arm 197 is in an upwardly extending position.

Figure 14:
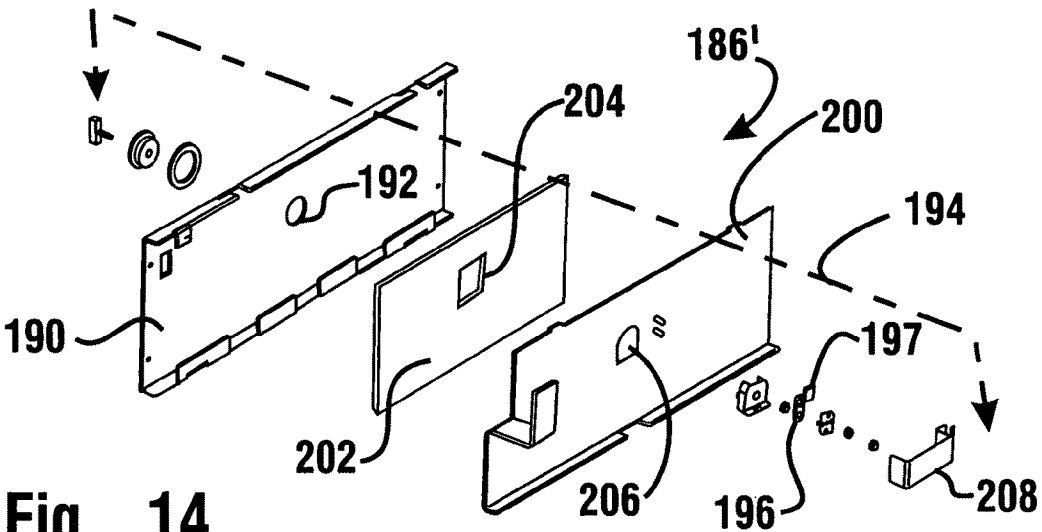
FIG. 14 is an exploded view of an alternate panel assembly.

With particular reference to FIG. 14, rear panel assembly 186' includes a backup plate 200 and a gasket member 202 disposed in adjoining relationship with rear panel 190. Openings 204 and 206 in gasket member 202 and backup plate 200, respectively, are generally aligned with opening 192. Rear panel assembly 186' further includes a backup plate lock cover 208 adapted to substantially cover latch assembly 194. Backup plate lock cover 208 is positioned to allow unhindered movement of latch member 196, and to not interfere with movement of drawer 50.

The alternate embodiment of rear panel assembly 186' provides an enhanced safety feature for the exemplary deal drawer 16. This construction reduces the risk of injury to an operator if a firearm is fired through opening 20 when the drawer 50 is in the extended position.

Operation of the exemplary deal drawer 16 may include initial action by a customer including activating the call button 28 to alert an operator. In a normal inoperative position the drawer is in the retracted position. If the drawer assembly 60 is initially engaged by latch member 196, the latch assembly is operated to disengage the latch member 196.

The operator causes exemplary drawer 50 to move into the extended position by manually moving the manual movement device, including knob member 46, within elongated slot 44 toward the front of housing 36. Movement of the drawer 50 toward the extended position also moves the cam member 68. Cam follower 84 moves within channel 72 from the inclined portion 74 into the straight portion 76. In coordinated movement, the pivot arm 82 pivots from an angled position, shown in FIG. 4, to a generally vertical position, shown in FIG. 5. The clutch housing 130 is attached to the pivot arm 82 and pivots therewith. If the clutch assembly 66 is in the engaged configuration, and the panel 42 is initially in the raised position, movement of the drawer 50 toward the extended position will cause coordinated rotational movement of the panel 42 to the lowered position closing the opening. Detent plate 132 will rotate with the clutch housing 130 due to the portion of each detent member 134 extending into an associated detent site 160. Rotation of the detent plate rotates the pivot rod 90, thereby causing central portion 102 to act on the underside 104 of panel 42 to move the panel.

Figure 15:
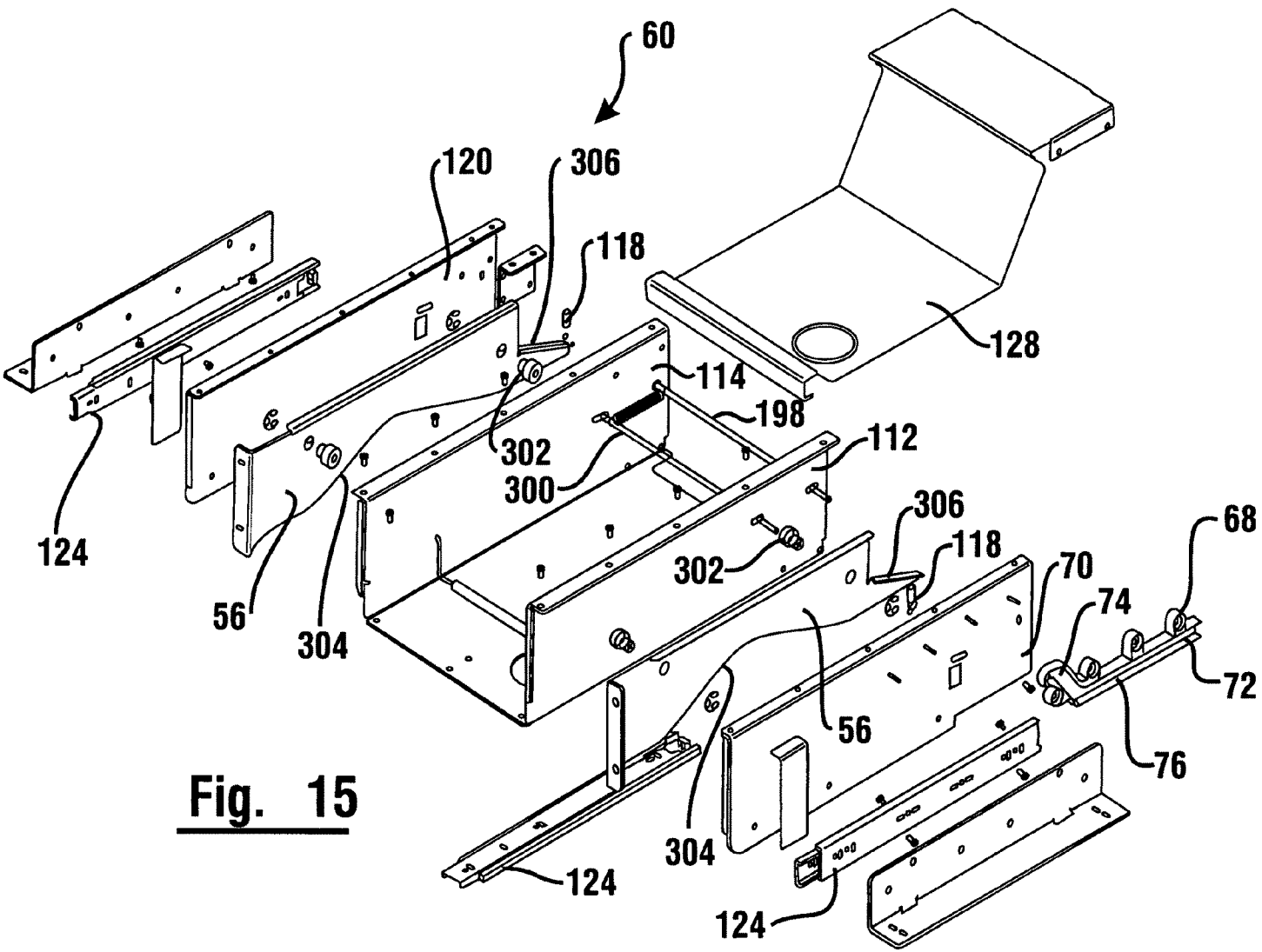
FIG. 15 is an exploded view of a drawer assembly of an exemplary deal drawer apparatus.

With reference to FIG. 15, as the exemplary drawer extends, drop flanges 56 that are pivotally mounted to opposite ends of flange rod 300 with drop flange bushings 302, move within gap 58 (FIG. 2) as surfaces 304 ride on drop flange rollers 170 (FIG. 12). The movement of drop flanges 56 is limited by contact of end surfaces 306 with flange rod 198. In coordinated movement, door 22 moves downward providing access through opening 20.

In the exemplary embodiment, moving the drawer to the retracted position is accomplished by the operator manually moving the knob member 46 toward the rear of the housing. As drawer retracts, the above described process is essentially reversed. The drop flanges 56 are urged upward into the initial condition by spring members 118. Likewise, biasing member 96 of the counterweight mechanism 92 urges the panel 42 into the open position.

In one scenario for operation of the exemplary embodiment, the deal drawer assembly may initially have the drawer 50 in the retracted position, and the panel 42 in a raised position as shown in FIG. 4. In this initial configuration, the exemplary clutch assembly will be in the engaged configuration. In the exemplary embodiment in the engaged configuration, the chambers 136 in the clutch housing 130 are each axially aligned with a detent site 160 in the detent plate 132, and a portion of each of the detent members 134 extends into a respective detent site 160. The pivot arm 82 will be in an angled position as shown in FIG. 4. When an operator moves the drawer 50 into the extended position, as shown in FIG. 5, the pivot arm 82 pivots in a first angular direction into the generally vertical position, as shown. The clutch housing 130 pivots with the pivot arm 82, causing rotation of the pivot rod 90 as long as the clutch remains in the engaged configuration, to move the panel 42 into the lowered position, closing the opening.

In this exemplary scenario, if the panel is retained in the lowered position by application of a resistive force, for example by an external object such as an operator's hand, during movement of the drawer 50 from the extended position toward the retracted position, the clutch assembly 66 will change to a disengaged configuration. This change in condition will occur because, with movement of the drawer member, the pivot arm 82 will pivot in an opposite angular direction from the generally vertical position shown in FIG. 5 to the angled position shown in FIG. 4. However, if the panel 42 is held such that it cannot move, the pivot rod 90 will not rotate, and detent plate 132 cannot rotate with movement of the clutch housing 130. Thus, the chambers 136 and detent sites 160 will relatively move to be offset from the aligned position, and the clutch assembly will be in the disengaged condition.

If the clutch is in the disengaged condition, when the drawer is in the retracted position, the operator moves the panel 42 into the open position, the pivot rod 90 will rotate, causing rotation of the detent plate 132. Eventually, the detent plate 132 will move to an aligned position relative the clutch housing 130 and the clutch assembly will re-engage.

If the operator does not move the panel 42 into the open position, the clutch assembly will remain disengaged. Subsequent movement of the drawer 50 into the extended position will cause the pivot arm 82 to pivot into the generally vertical position again and move the clutch housing back into the aligned position to re-engage the clutch assembly. Of course this approach is exemplary.

In another scenario using the exemplary embodiment, an operator can move the panel 42 into the closed position before moving the drawer from the retracted position into the extended position. As the panel 42 is manually closed absent drawer movement, the clutch will become disengaged. In this scenario, the pivot rod 90, and therefore detent plate 132, rotates with the movement of the panel member. However, clutch housing 130 remains stationary. The detent sites 160 are no longer axially aligned with the chambers 136, causing withdrawal of the detent members 134. Even though the clutch assembly is disengaged, the drawer 50 can still be moved into the extended position. As the drawer moves toward the extended position, the pivot arm 82 moves the clutch housing so that the clutch housing 130 and the detent plate 132 are again axially aligned, and the clutch assembly is re-engaged.

Thus, as will be apparent, there are various scenarios wherein movement of the exemplary drawer may be independent of movement of the panel member, movement of the panel may be independent of the drawer movement, or movement of the drawer may be coordinated with movement of the panel member. Also, if the exemplary clutch 66 is in the disengaged configuration, subsequent movement of the panel 42 or the drawer 50 is operative to re-engage the clutch. As can be appreciated, in the exemplary embodiment the clutch firmly operatively connects the panel and pivot arm until it encounters a resistance force above a level that causes the detent members to disengage from the detent sites. After disengagement, the exemplary clutch assembly provides a less firm connection between the pivot arm and the panel until the detent members re-engage the chambers. Of course, this approach to providing relatively greater and lesser force transmission is exemplary.

During operation of the exemplary deal drawer apparatus, the overall position of the clutch 66 does not change, but the clutch housing pivots with the pivot arm 82 and the detent plate 132 rotates with pivot rod 90. If the clutch assembly is in the engaged configuration, the movement of the clutch housing will be coordinated with movement of the detent plate member. If the clutch assembly is in the disengaged configuration, either the clutch housing or the detent plate may move more readily independently of the other component.

In the exemplary embodiment, the detent mechanism utilizes three chambers, three detent members, and three detent sites. However, other constructions are possible with other embodiments. In the exemplary embodiment, the detent mechanism operates so that even if the drawer is moved quickly between the extended and retracted positions, the clutch assembly will remain engaged. The detent mechanism also operates in the exemplary embodiment to readily disengage the clutch assembly if for example, an obstruction is encountered in movement of the panel to prevent damage to the deal drawer components.

Thus, the exemplary embodiments of the deal drawer achieve one or more of the above stated objectives, eliminate difficulties encountered in the use of prior devices and systems, solve problems, and attain the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

The invention claimed is:

1. Apparatus comprising:

a deal drawer adapted to pass items between persons on opposed sides of a wall, wherein the wall divides an interior area and an exterior area, including:

a housing, wherein the housing includes an opening therein;

a panel, wherein the panel is movably mounted in operatively supported connection with the housing;

a drawer, wherein the drawer is movably mounted in operatively supported connection with the housing, wherein the drawer includes a holding area adapted to hold items therein, and wherein the drawer is movable between a retracted position wherein the holding area is accessible through the opening, and an extended position wherein the holding area is accessible from outside the housing from the exterior area;

a mechanism operatively connecting the drawer and the panel, wherein the mechanism is operative to cause the panel to move in coordinated relation with movement of the drawer, wherein the panel moves between an open position and a closed position, wherein when the drawer is moved from the extended position to the retracted position the panel is moved to the open position responsive to the mechanism whereby the holding area is accessible through the opening, and wherein when the drawer is moved from the retracted position toward the extended position the panel is moved from the open position to the closed position responsive to the mechanism; and wherein the mechanism includes a clutch, wherein the clutch enables panel movement that is not coordinated with the drawer movement.

2. The apparatus of claim 1 wherein the clutch is operative to transition between an engaged configuration and a disengaged configuration, wherein when the clutch is in the engaged configuration the clutch is able to transmit sufficient force through the mechanism to move the panel in coordination with movement of the drawer, and wherein when the clutch is in the disengaged configuration the clutch is unable to transmit sufficient force through the mechanism to move the panel in coordination with movement of the drawer.

3. The apparatus of claim 2 wherein with a force below a threshold force acting on the mechanism when the clutch is in the engaged configuration, the clutch is able to resist panel movement to transition to the disengaged configuration.

4. The apparatus of claim 3 wherein with a force greater than the threshold force acting on the mechanism when the clutch is in the engaged configuration, the clutch is able to allow the panel to move independent of the mechanism to transition to the disengaged configuration.

5. The apparatus of claim 4 wherein responsive to drawer movement when the clutch is in the disengaged configuration, the mechanism is able to transition the clutch to the engaged configuration.

6. The apparatus of claim 4 wherein responsive to panel movement when the clutch is in the disengaged configuration, the mechanism is able to transition the clutch to the engaged configuration.

7. The apparatus of claim 1 wherein the clutch includes:

a clutch housing including a body having first and second spaced ends, the body having a first surface at the first end;

a detent plate mounted in operatively supported connection with the clutch housing, wherein the clutch housing and the detent plate are adapted for relative rotational movement, wherein the detent plate comprises a detent surface adjacent and in generally opposed facing relation relative to the first surface;

a detent mechanism operative to place the clutch in the engaged configuration when the detent plate and the clutch housing are in at least one predetermined relative rotational position;

wherein when the clutch is in the engaged configuration, the clutch housing and the detent plate are releasibly operatively engaged, wherein the clutch housing and the detent plate move in coordinated relation, and wherein when the clutch is in the disengaged configuration, the clutch housing and the detent plate are each relatively rotatably movable independently of one another.

8. The apparatus of claim 7 wherein the drawer includes a front portion and a rear portion, wherein the rear portion is disposed from the front portion in a direction of movement, wherein the drawer moves along the direction of movement between the extended position and the retracted position; and wherein the mechanism includes a cam member mounted in operatively supported connection with the drawer and movable therewith, wherein the cam member includes a channel having a first end disposed toward the front portion of the drawer and a second end disposed toward the rear portion of the drawer.

9. The apparatus of claim 8 further comprising:

an arm movably mounted in operative supported connection with the housing and in operative connection with the mechanism, wherein the arm includes a distal end; and a cam follower mounted in operative supported connection with the arm, wherein the cam follower is adjacent the distal end of the arm, wherein the cam follower extends in the channel, wherein the cam follower moves relative to the channel responsive to movement of the drawer, and wherein the arm moves responsive to movement of the cam follower.

10. The apparatus of claim 9 wherein the channel includes a vertically angled portion, wherein the angled portion extends adjacent the first end, and a straight portion, wherein the straight portion extends adjacent the second end, wherein movement of the cam follower in the angled portion is operative to cause rotational movement of the arm, and wherein rotational movement of the arm is operative to apply a rotational force to the clutch.

11. The apparatus of claim 10 wherein the mechanism further includes:

a pivot rod, wherein the pivot rod includes first and second spaced rod end portions disposed along a common axis, and wherein the pivot rod includes a central rod portion disposed intermediate of the first and second spaced rod end portions, wherein the central rod portion is radially disposed relative to the common axis, wherein the first end portion is operatively connected with the detent plate, and wherein the central rod portion is operatively engaged with the panel, and wherein rotation of the clutch and detent plate in a first angular direction responsive to movement of the arm is operative to move the panel into the closed position responsive to movement of the pivot rod, and wherein rotation of the clutch and pivot plate in a second angular direction, opposed of the first angular direction, is operative to move the panel into the open position responsive to movement of the pivot rod.

12. The apparatus of claim 11 wherein the panel includes a lower side, and wherein the mechanism further includes:

a bracket mounted in operatively supported connection with the lower side of the panel, wherein the bracket includes a bracket portion defining an open region, and wherein the central portion of the pivot rod extends in the open region.

13. The apparatus of claim 10 wherein the housing includes an elongated slot, wherein the elongated slot extends along the direction of movement of the drawer, and further comprising:

a movement mechanism in operative supported connection with the drawer, wherein the movement mechanism is operative to selectively move the drawer between the extended and retracted positions, and wherein the movement mechanism includes a handle movable in the elongated slot.

14. The apparatus of claim 1 wherein the panel is rotationally movably mounted in operatively supported connection with the housing, wherein the panel moves in a first rotational direction during panel movement from the panel open position to the panel closed position, wherein the panel moves in a second rotational direction during panel movement from the panel closed position to the panel open position, wherein the second rotational direction is opposite the first rotational direction.

15. The apparatus of claim 10 wherein the detent mechanism includes:

a plurality of angularly spaced longitudinally extending chambers extending in the body and through the first surface;

a plurality of detent members, wherein one detent member is disposed in each chamber, and wherein each detent member is longitudinally movable in the respective chamber; and a plurality of detent member engaging sites in the detent surface, wherein each detent member engaging site is operative to releasibly engage one detent member, and wherein when the detent plate and the clutch housing are in at least one relative rotational position, at least one detent member engages at least one detent site.

16. The apparatus of claim 15 wherein the detent mechanism further includes a plurality of spring members, wherein one spring member is positioned in each chamber and is operative to bias a respective detent member to engage the detent surface.

17. The apparatus according to claim 16 wherein each detent member comprises a cylindrical surface disposed adjacent the detent surface, and wherein each detent site comprises a recess configured to engage the cylindrical surface.

18. The apparatus of claim 10 wherein the drawer has a forward opening, wherein the holding area is accessible from the exterior area through the forward opening, and further comprising a door assembly including:

first and second spaced drop members each movably mounted in operatively supported connection with the drawer and movable in coordination therewith between an upward position and a downward position; and a door mounted in operatively supported connection with the first and second drop members and moveable therewith, wherein when the drawer is in the retracted position, the first and second drop members are each in the upward position and the door selectively closes the forward opening, and when the drawer is in the extended position the first and second drop members are each in the downward position and the door is disposed relative to the forward opening such that the holding area is accessible therethrough.

19. Apparatus comprising:

a deal drawer adapted to pass items between persons on opposed sides of a wall, wherein the wall divides a first area and a second area, including:

a housing, wherein the housing is adapted to extend through the wall, wherein the housing includes a first surface having a first opening therein, wherein in an operative position of the deal drawer the first surface extends generally horizontally and in the first area, wherein an interior area of the housing is accessible generally vertically through the first opening, and wherein the housing includes a second opening, wherein in the operative position of the deal drawer the second opening extends generally vertically and enables accessing the interior area of the housing from the second area through the second opening;

a panel movably mounted in operatively supported connection with the housing, wherein the panel is movable between a panel closed position wherein the panel closes the first opening, and a panel open position wherein the panel is positioned relative to the first opening such that the interior area is accessible through the first opening;

a drawer, wherein the drawer is movably mounted in operatively supported connection with the housing, wherein the drawer includes a holding area therein, and wherein the drawer is movable between a retracted position wherein the holding area is generally aligned with the first opening and the holding area is accessible through the first opening, and an extended position wherein the holding area is accessible through the second opening from the second area;

a mechanism in operative mechanical connection with the panel and the drawer, wherein the mechanism is operative to cause the panel to move in coordinated relation with movement of the drawer, wherein the mechanism is operative to cause the panel to move to the panel open position responsive to movement of the drawer to the retracted position, and wherein the mechanism is operative to cause the panel to move to the panel closed position responsive to movement of the drawer from the retracted position toward the extended position, wherein the mechanism includes two relatively movable members, wherein the two relatively movable members are non-rigidly operatively engaged by a structure such that the members move together as the panel moves with movement of the drawer, and wherein the non-rigid operative engagement through the structure enables moving the panel between the open panel position and the closed panel position without movement of the drawer, wherein the mechanism includes a clutch, wherein the clutch enables panel movement that is not coordinated with the drawer movement.

20. The apparatus of claim 19 wherein the panel is rotationally movably mounted in operatively supported connection with the housing, wherein the panel moves in a first rotational direction during panel movement from the panel open position to the panel closed position, wherein the panel moves in a second rotational direction during panel movement from the panel closed position to the panel open position, wherein the second rotational direction is opposite the first rotational direction.

21. The apparatus according to claim 19 wherein the non-rigid operative engagement of the two members through the structure enables movement of the drawer to the retracted position without movement of the panel.

22. The apparatus according to claim 21 wherein the structure providing non-rigid operative engagement of the two members includes a detent mechanism.

23. The apparatus according to claim 22 wherein the clutch includes the detent mechanism, and wherein the detent mechanism comprises a detent ball supported by one member and a recess configured to accept a portion of the detent ball on the other member, and a spring, wherein the spring biases the ball to engage the recess.

24. The apparatus according to claim 23 wherein the mechanism comprises a cam and a cam follower, wherein one of the cam and the cam follower are in operatively fixed connection with the drawer, wherein movement of the drawer causes relative movement of the cam and the cam follower.

25. The apparatus according to claim 24 wherein the panel moves between the panel open position and the panel closed position through rotational movement relative to the housing, and wherein the mechanism includes a pivot rod, wherein the pivot rod includes an offset portion, wherein the offset portion is radially offset from an axis about which the pivot rod rotates in operatively supported connection with the housing, and wherein rotation of the pivot rod relative to the housing operatively engages the panel and causes movement of the panel between the panel open position and the panel closed position.

26. The apparatus according to claim 25 and further comprising a door, wherein the door is movably mounted relative to the housing, wherein the door is operative to close the second opening when the drawer is in the retracted position.

27. The apparatus according to claim 26 wherein the door is movably mounted in operatively supported connection with the drawer through at least one member, wherein the at least one member is mounted in operatively supported connection with the door so as to be angularly movable relative to the drawer, and wherein the at least one member is operative to lower the door as the drawer moves toward the extended position, and to raise the door as the door moves from the extended position toward the retracted position.

28. A method comprising:

(a) moving a drawer from a retracted position to an extended position, wherein the drawer is part of a deal drawer adapted to pass items between persons on opposed sides of a wall that divides an interior area and an exterior area, wherein the deal drawer includes a housing, a panel, and a mechanism, wherein the mechanism operably connects the drawer and the panel, wherein the panel is movably mounted in operatively supported connection with the housing, wherein the drawer is movably mounted in operatively supported connection with the housing, wherein the drawer includes a holding area adapted to hold items therein, wherein when the drawer is in the retracted position the panel is in an open position enabling access to the holding area through an opening in the housing, wherein when the drawer is in the extended position the panel is in a closed position preventing access through the opening, wherein when the drawer is in the extended position the holding area is accessible from the exterior area, wherein the mechanism includes a clutch, wherein the clutch enables panel movement that is not coordinated with the drawer movement; and (b) causing the mechanism to move the panel from the open position to the closed position in coordinated relation with movement of the drawer in step (a).

29. The method of claim 28 wherein the clutch includes a clutch housing and a detent plate mounted in supporting connection with the clutch housing, wherein the clutch housing and the detent plate are relatively rotationally movable, and further comprising:

placing the clutch into a disengaged configuration by rotating the detent plate relative the clutch housing, wherein the detent plate rotates away from at least one predetermined relative position.

30. The method of claim 28 wherein the clutch includes a clutch housing and a detent plate mounted in supporting connection with the clutch housing, wherein the clutch housing and the detent plate are relatively rotationally movable, and further comprising:

placing the clutch into an engaged configuration by relatively rotating the clutch housing and the detent plate into at least one predetermined relative position.

31. The method of claim 28 and further comprising:

moving the panel responsive to movement of the drawer by rotating the clutch responsive to movement of the drawer.

32. The method of claim 28 and further comprising:

placing the clutch assembly into a disengaged configuration by rotating a detent plate away from at least one predetermined angular position relative to a clutch housing, wherein the detent plate is operatively connected with the panel and movable therewith;

placing the clutch into an engaged configuration by moving a pivot arm in operative connection with the clutch housing to rotate the clutch housing into one of the at least one predetermined angular position relative to the detent plate; and moving the panel responsive to movement with the drawer by operating the clutch in the engaged configuration.

33. The method of claim 28 further comprising:

(c) applying a resistive force to the panel, wherein the resistive force is operative to disengage the clutch, wherein when the clutch is disengaged panel movement is not coordinated with drawer movement.

34. The method of claim 33 further comprising:

(d) subsequent to step (c), moving one of the drawer or the panel to engage the clutch, wherein when the clutch is engaged panel movement is coordinated with the drawer movement.

* * * * *